US008898873B2

(12) United States Patent
Bailey

(10) Patent No.: US 8,898,873 B2
(45) Date of Patent: Dec. 2, 2014

(54) ACRYLIC URN VAULT

(71) Applicant: Keary Dayne Bailey, Buda, TX (US)

(72) Inventor: Keary Dayne Bailey, Buda, TX (US)

( * ) Notice: Subject to any disclaimer, the term of this patent is extended or adjusted under 35 U.S.C. 154(b) by 0 days.

(21) Appl. No.: 13/815,507

(22) Filed: Mar. 7, 2013

(65) Prior Publication Data

US 2014/0250645 A1 Sep. 11, 2014

(51) Int. Cl.
*A61G 17/00* (2006.01)
*A61G 17/007* (2006.01)

(52) U.S. Cl.
CPC ..... *A61G 17/007* (2013.01)
USPC ..... 27/1; 52/128

(58) Field of Classification Search
CPC ..... A61G 17/00; A61G 17/08; E04H 13/00; E04H 13/001; E04H 13/008
USPC ..... 27/1, 35; 52/128, 138–142; 211/85.27
See application file for complete search history.

(56) References Cited

U.S. PATENT DOCUMENTS 4,224,602 A * 9/1980 Anderson et al. ..... 340/321
5,349,727 A * 9/1994 Niebergall ..... 27/1
D374,962 S * 10/1996 Allen et al. ..... D99/5
5,732,452 A * 3/1998 Riedel, II ..... 27/1
6,052,954 A * 4/2000 Dudek et al. ..... 52/128
D433,209 S * 10/2000 Baldwin et al. ..... D99/5
6,484,457 B1 * 11/2002 Dudek et al. ..... 52/128
7,421,765 B1 * 9/2008 Kaiser ..... 27/1
7,478,461 B2 * 1/2009 Glass ..... 27/1
8,083,275 B2 * 12/2011 Myhre et al. ..... 294/16
8,087,132 B2 * 1/2012 Forrest et al. ..... 27/1
2005/0125973 A1 * 6/2005 Hankel et al. ..... 27/1
2007/0033777 A1 * 2/2007 Blessing ..... 27/1

* cited by examiner

*Primary Examiner* — William Miller
(74) *Attorney, Agent, or Firm* — Halsey Calhoun P.C.; William N. Halsey, III; Beau Horner

(57) ABSTRACT

The sealing acrylic urn vault of the invention includes a generally square sheet of ⅝" cast acrylic serving as the base and a generally square top portion which will have four adjacent side walls bonded to its edges and protruding downward. Each opposing side wall will be bonded length-wise to each adjoining side, creating a seamless cast acrylic box, open at the bottom, that lowers onto the acrylic base. Attached to the base are four 0.625" tall ⅝" thick acrylic guide rails, bonded equidistant from the outside base edge on all four sides of the base. This "railing system" is the fastening guide for the acrylic top portion which lowers onto the base with the inside of the four side walls bonded with the outside edges of the four guide rails.

18 Claims, 7 Drawing Sheets

ACRYLIC URN VAULT

FIELD OF THE INVENTION

The present invention relates to the field of cremation urn burial vaults and, more particularly, to a cast acrylic urn vault used to protect and preserve, in a sealed environment, buried urns containing cremated remains.

BACKGROUND OF THE INVENTION

There are already a number of solutions for protecting cremation urns. Most of these solutions, however, fail to satisfy the requirements of the cremation industry in that they are large, heavy, cumbersome and they often price themselves out of the reach of the average consumer. Most of the cremation urn vaults currently available to consumers are made of concrete, steel, polymers, granite, marble, ceramic or stained glass, steel, and even wood and are so heavy that outside agencies must be paid to deliver and install these current urn vaults. Today, there exists a desire for a lighter, more easily-handled cremation urn vault that is impervious to nature's elements to a greater degree than concrete, polymers, and the like. There is a need for a stronger structure that does not have the weaknesses of existing vaults and can withstand the heavy weight of the covering soil as well as any heavy equipment that passes overhead. With thousands of additional families choosing cremation every day, there is a tremendous need for a protective, sealing, urn vault with far greater stability than what is offered in the industry today. Such an efficient urn vault would streamline installation, to the point where the actual families involved could lower the urn vault into its burial position by themselves, allowing for additional closure for grieving loved ones. Also, this new invention would lower overall installation costs and still guarantee the confidence and peace of mind for grieving families. Funeral homes and funeral director's have never been able to sell any current protective urn vault on a preneed basis because they are so large that consumers can't take immediate possession of the vaults and these sales are limited to at-need families. Preneed sales account for a large part of funeral home profits and this present acrylic urn vault invention is extremely light, easily handled by funeral employees and family members, as well as dynamic in its presentation and will be a very desirable product to the preneed market. With cremation on the rise around the world, there is a greater need for an attractive, secure, and stable sealing urn vault that suffers from none of the stability and installation problems of the current urn vault solutions today. This cast acrylic urn vault invention satisfies that need.

Most urn vaults are designed with a base adhered to sidewalls and a lid that closes from the top. Essentially, most cremation urn vaults are simply heavy boxes. These all portend to seal and protect the urn, but fail either because of the hefty weight, inferior build quality that breaks down in extreme soil conditions, or they fail because of the exorbitant costs associated with handling and burying these vaults.

U.S. Pat. No. 7,421,765 is an aesthetically pleasing vault and urn system where the vault and the urn are covered with materials capable of resisting deterioration for extended periods of time. The failure here is that the vault is "covered with materials" that resist deteriorization. These materials, underground, will break down, separate, and fail, leaving the urn and cremains to the elements. Any covered product placed underground will eventually break down. That is certain.

U.S. Pat. No. 4,648,162 utilizes the beauty of stained glass combined with innovative assembly techniques to provide a cremation urn that is pleasing in appearance, light in weight, rugged in construction, and moisture and dust resistant. Yet, this urn vault could not be used to protect urns that are buried in-ground. The weight of the soil and pressures associated with in-ground burials would crack the stained glass and break immediately.

U.S. D432285 is a cremation urn vault with an ornamental design. It is a heavy concrete box that is costly to install and impossible to handle, except for cemetery professionals. Water and soil moisture eventually weaken any underground concrete structure. This concrete box is no different and is extremely susceptible to moisture.

Although these and other urn vaults are available, there is still a need for a new cremation urn vault, unlike any of these existing vaults. A patent search was recently performed for this new invention, targeting all cremation urn vaults, cremation vault assemblies, and cremation urn containers. The patent search "failed to locate any references considered to be of relevance" to this new cremation urn vault invention. This invention is a much more structurally sound urn vault capable of being handled easily for burial and decorative enough to serve as a display for an urn in a home setting. This acrylic urn vault seals tightly when underground, eliminating the threat of water, air, insects, and molds as well as being able to withstand any weight pressing on it from above. This sealing concept is exactly like an empty glass turned upside down in a sink full of water. The trapped air inside the glass presses against the water and doesn't allow any to get in. This new invention works in a similar fashion, except there are extra precautions inherent to the device that would never allow water, soil, insects, molds, etc. to enter and contaminate the urn or cremains.

The majority of existing urn vaults today are very heavy and require either machinery and/or extensive man-power to handle them. This weight problem creates additional labor and increased costs. Concrete urn vaults, the most prominent on the market today, can weigh well over 100 lbs. and those skilled in the art recognize that these are extremely difficult to lower into burial spaces. Also, most concrete vaults have inner polymer liners to protect the urns because over time, water and moisture will weaken the integrity of the aggregate concrete, leading to cracks and eventual failure. Once failure occurs, the plastic liners collapse, leaving the cremation urn and its contents vulnerable to the underground elements. For the size required, granite and marble urn vaults are simply cost prohibitive and their weight is similar, if not greater than concrete. Ceramic and glass are much too fragile to entrust with protecting a family's "buried" urn and wood is simply a bio-degradable substance that deteriorates quickly, much like water-based, aggregate concrete. Also, if a family were to request a disinterment to remove a buried urn or to add an additional urn, concrete urn vaults are extremely difficult to remove and if in fact the vault is still intact at the time of removal, the concrete lid will have to be broken in order to remove the urn. The concrete lid pieces falling into the vault could also damage the urn. Steel urn vaults do not seal, leaving the enclosed urn vulnerable to insects, molds and more, and even galvanized steel will succumb to rust in a moist environment. This new cast acrylic cremation urn vault will successfully address all of these existing urn vault issues by being extremely strong and durable, easily handled, capable of being reopened and resealed if requested, and can be easily manufactured as well as quickly assembled.

SUMMARY OF THE INVENTION

In accordance with the present invention, there is provided a sealing, acrylic urn vault which is both functional and decorative. The cremation urn vault of the invention is comprised of ⅝" thick, cast acrylic which when bonded, provides a completely sealed environment devoid of any penetration by water, moisture, air or insects. The urn vault includes a generally square piece of acrylic serving as the base and a generally square top panel which will have four adjacent side walls cemented to its edges and all four protruding downward. Each opposing side wall will be bonded length-wise to each adjoining side, creating a seamless acrylic box, open at the bottom, that lowers onto the base. All acrylic pieces are bonded using a special acrylic solvent adhesive which molds adjoining pieces into a single entity by first softening the acrylic surfaces to be joined and then fusing them together when the solvent dissipates, leaving a strong glue-free joint. This is referred to as "solvent welding" or "adhesively bonded". Both terms will be used throughout. Because the solvent adhesive used is formulated for adhering acrylic sheets to themselves, the resulting pieces have the tensile strength of a single, solid sheet of acrylic. Attached to the base are 0.625" tall ⅝" thick guide rails which are bonded equidistant from the outside edge on all four sides of the base. This "square railing system" serves as the resting guide for the acrylic top box which then lowers onto the base with the four sides walls resting against the outside of the four rails. The fit is such that the top walls are held securely in place by the guide rails with no opportunity to slide or move in its position on the base. Underneath the acrylic base are four 1" square cubes that are set in 1" from the sides at each corner. The four cubes serve as the pedestal feet which make the device protable. Also, the underneath space created by the pedestal feet would allow the use of straps or ropes if the urn vault is to be lowered into the ground any distance that might make it difficult to be lowered by hand. This acrylic invention can also be made of ¾" panels to warrant extra protection from unusually heavy equipment or extremely harsh environments. This acrylic urn vault can also be altered to meet any urn size requirement as side walls may be increased in height and the base unit would adjust accordingly. This description doesn't put any limitations on the present invention's makeup or configuration.

This acrylic urn vault serves to protect the integrity of the cremation urn for a much longer period of time than the current heavy, concrete urn vaults. It is impervious to the two inherent weaknesses of concrete. Acrylic is not affected by moisture as is concrete and is chemically-resistant and impact-resistant. Also, a 1" thick acrylic sheet is bullet-proof and has been tested at 9600 psi while concrete has a maximum strength of 700 psi. This acrylic urn vault, at ⅝" thickness, has a minimum tensile strength of 1500 psi, still twice that of any current concrete urn vault. One vital purpose of this acrylic urn vault is that at only 12 lbs., it is very easily moved and can be handled by most any consumer, unlike the average concrete urn vault which weighs in at well over 100 lbs. Such concrete, steel, and marble/granite/bronze vaults require extra labor and machinery to move them into place. Since the acrylic urn vault is very light, it can also serve as a decorative, presentation device in the homes of families that delay urn burial for any length of time. In a home, the acrylic vault can both separate and protect the cremation urn in a decorative environment until a time is selected for inurnment. At that point, the entire acrylic device may be taken to the final resting place. Once the vault is lowered into place with the urn inside, an acrylic solvent adhesive is administered along the outside of the vault base guide rails which will permanently bond the adjoining acrylic pieces, sealing the urn inside for all time. Another option at the time of interment is for the acrylic base and top to be placed in position without the bonding compound, leaving the vault in a position to be opened at any point in the future should the family choose to do so. Even without the use of the sealing adhesive, the weight of the topsoil and grass holds the top of the vault in place, with the trapped air pressure sealing the urn inside, free of the threat of water, insects, mold, and the weight of heavy equipment.

It would be advantageous to provide a sealing urn vault that protects the cremation urn in an isolated, underground environment created by trapped air pressure which prevents any water, moisture, or underground contaminants from entering the urn vault.

It would also be advantageous to provide a cremation urn vault that offers a sealed environment even if the urn vault is not permanently sealed by solvent adhesive. Once the top is placed onto the base, held in place by the base guide rails, the trapped air pressure inside the vault works in the same manner to repel water, chemicals, and insects as when sealed permanently.

It would further be advantageous to provide a sealing cremation vault that when no solvent adhesive is required, at any time in the future, the vault may be reopened simply by removing the fill dirt and lifting the vault top off of the base. This is required if a family requests a disinterment or if they wish to place a second urn inside the vault which can then be permanently sealed once the final urn is in place. No other existing cremation urn vault serves this purpose.

The current invention offered is relative to the current trends in today's death industry regarding cremation. Each year, tens of thousands of additional families are choosing to move away from traditional casket burials and are instead, selecting cremation as a preferred means of final disposition. And in doing so, cremation ashes are placed into various types of cremation urns, including wood, bronze, marble, ceramic, and even plastic containers. A large percentage of these families are choosing to bury the cremation remains in cemeteries, private sites, and in garden settings. If the cemetery or cremation garden requires an outer burial container for cremation ashes or if the consumer wants additional protection for the buried urn, this acrylic urn vault serves that purpose. If an urn vault is not required, but the family requests the vault just to guarantee the integrity of the urn, itself, this urn vault serves that purpose. And if a grieving family wishes to take part in the burial ceremony to achieve closure, they may place this cremation urn vault into the designated grave space themselves and this invention serves that purpose as well, an act not allowed by current urn vault solutions. And, as previously stated, many families are delaying the act of interring the cremation urn and this invention serves the purpose of providing a protective and decorative display device for the urn before and after the burial takes place.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DESCRIPTION OF THE PREFERRED EMBODIMENT

The present invention will now be described more fully, referencing the accompanying drawing FIGS. 1-7 in which the preferred embodiments of the invention are shown. This invention may also be embodied in several different forms and should not be considered limited only to the embodiment set forth here. Those skilled in the art will recognize the accompanying embodiments as illustrative in nature and should not be seen as limiting in any way. The embodiments of the present invention will fully disclose the scope of the invention to those that are skilled in the art.

Figure 1:
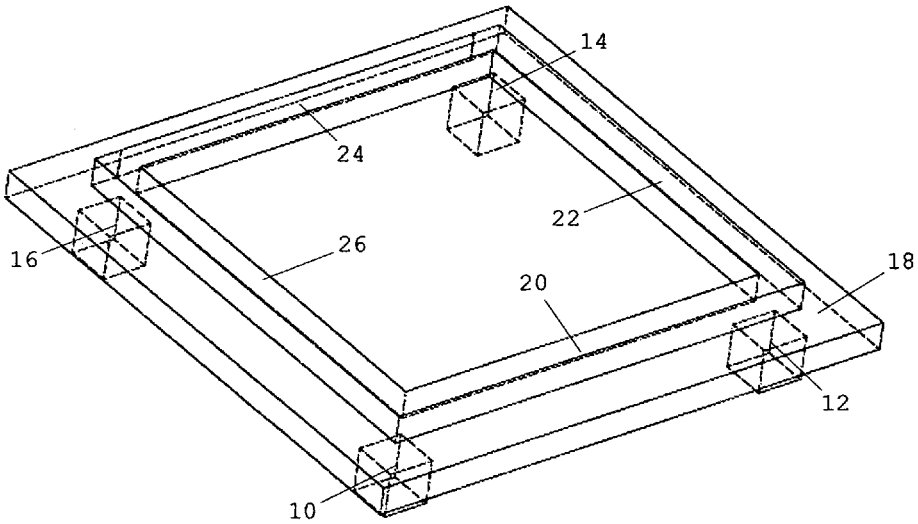
FIG. 1 is a bottom perspective view of an acrylic urn vault invention base with the sealing guide rails attached.

FIG. 1 illustrates a bottom perspective view of the acrylic urn vault 44 base 18 in accordance with the present invention. The present invention consists of a square base 18 and a corresponding rectangular top portion 42, open at the bottom, and will seal air and water tight with the square acrylic base 18. Both the top portion 42 and the base 18 are made of a ⅝" cell cast acrylic material. All acrylic pieces are bonded using a special acrylic solvent adhesive which molds adjoining pieces into a single entity by first softening the acrylic surfaces to be joined and then fusing them together when the solvent dissipates, leaving a strong glue-free joint. This is referred to as "solvent welding". Other polymeric materials may be used in this embodiment, however, cast acrylic is incredibly strong and resistant to the weight of any back-filled soil and overhead pressures associated with a buried urn vault. Cast acrylic is also very light, weighing half as much as its glass counterpart and at least one hundred pounds less than any current competitor's concrete or steel urn burial vaults. Cast acrylic makes the present invention extremely light, portable, and is more attractive as a preneed sales item to funeral homes and families in-need than any current known solution. Purchasers may easily carry this invention home to be used as an attractive, ornamental display case until such time as the cremation urn is to be sealed in the acrylic urn vault 44 (FIG. 3) and buried underground.

Referring to FIG. 1, the acrylic urn vault 44 base 18 is generally embodied as a 12"×12" square and is supported underneath by four 1"×1"×1" cubed, pedestal feet, inset 1" from each corner. Supporting the base 18 in the front are right front base pedestal foot 10 and left front base pedestal foot 12. Supporting the base 18 underneath at the rear are right rear base pedestal foot 16 and left rear base pedestal foot 14. All four pedestal feet are duplicated in size and shape. The positioning of the four pedestal feet allow the acrylic urn vault 44 base 18 to sit just above the soil when buried. Also, the cubed feet allow the acrylic urn vault 44 to be easily lifted, placed and moved about on a shelf or table when it serves as a presentation device prior to interment. The space created by the block feet would allow the use of straps or ropes if the urn vault is to be lowered into the ground any distance that might make it difficult to be lowered by hand. The present invention is unlike the current urn vault solutions which are either too heavy, too cumbersome or too bulky and most aren't intended for the consumer to view much less handle themselves. This acrylic urn vault 44 provides for this need.

FIG. 1 further illustrates the unique guide rail sealing system. The four guide rails measuring 9.75"×0.625"×0.625" are solvently welded to the base 18. The base 18 is comprised of right acrylic guide rail 26, left acrylic guide rail 22, front acrylic guide rail 20, and rear acrylic guide rail 24. These rails provide the fastening system for the top portion 42 where the opposing side panels 32 and 36 as well as the end panels 30 and 34 fit snugly against the outer edges of the guide rails where they will be solvently welded to the rails, sealing the described embodiment air and water tight.

Figure 2:
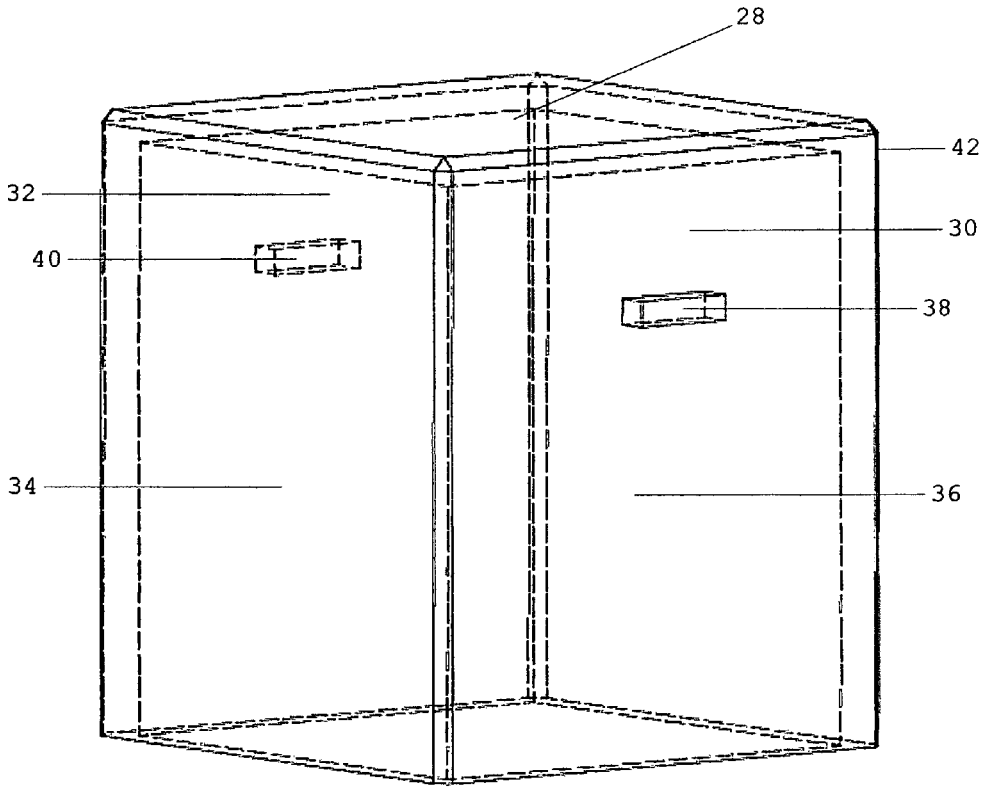
FIG. 2 is a top section view of an acrylic urn vault invention and its five-sided top rectangular section.

FIG. 2 illustrates a view of the top portion 42 of the present invention. The top portion 42 is comprised of a generally square top acrylic panel 28, and four rectangular sides, front acrylic panel 30, rear acrylic panel 34, left acrylic panel 32, and right acrylic panel 36. Each opposing panel is made of ⅝" cast acrylic and all are solvently welded to their adjacent panels as well as each is solvently welded to the top panel 28. The acrylic adhesive solvent distributed at each connecting joint molds the five acrylic pieces into a strong, weight-bearing single entity. Specifically, all five bonded acrylic pieces form a single entity, open at the bottom, and serving as the top enclosure 42. Also illustrated in FIG. 2 are the opposing top handles, the right side, top handle 38 and left side top handle 40. Each handle is made from cast acrylic and is 2"×0.5"×0.375", centered in middle side of each opposing side panel 32 and 36, 3" down from the top panel 28. The acrylic side handles 38 and 40 enable the acrylic urn vault (FIG. 3) to be lifted and lowered with ease. Those skilled in the art will appreciate that with the top side handles 38 and 40 that are solvently welded to the opposing side panels, it can be easily moved and because of its light weight, no outside agencies need to be contracted to install the acrylic urn vault 44 and those savings can be passed to the consumer. Current urn burial vault solutions do not meet the needs of the industry because they are much heavier, much more difficult to handle, and require additional machinery/manpower to install, resulting in additional expenses for the consumer.

Figure 3:
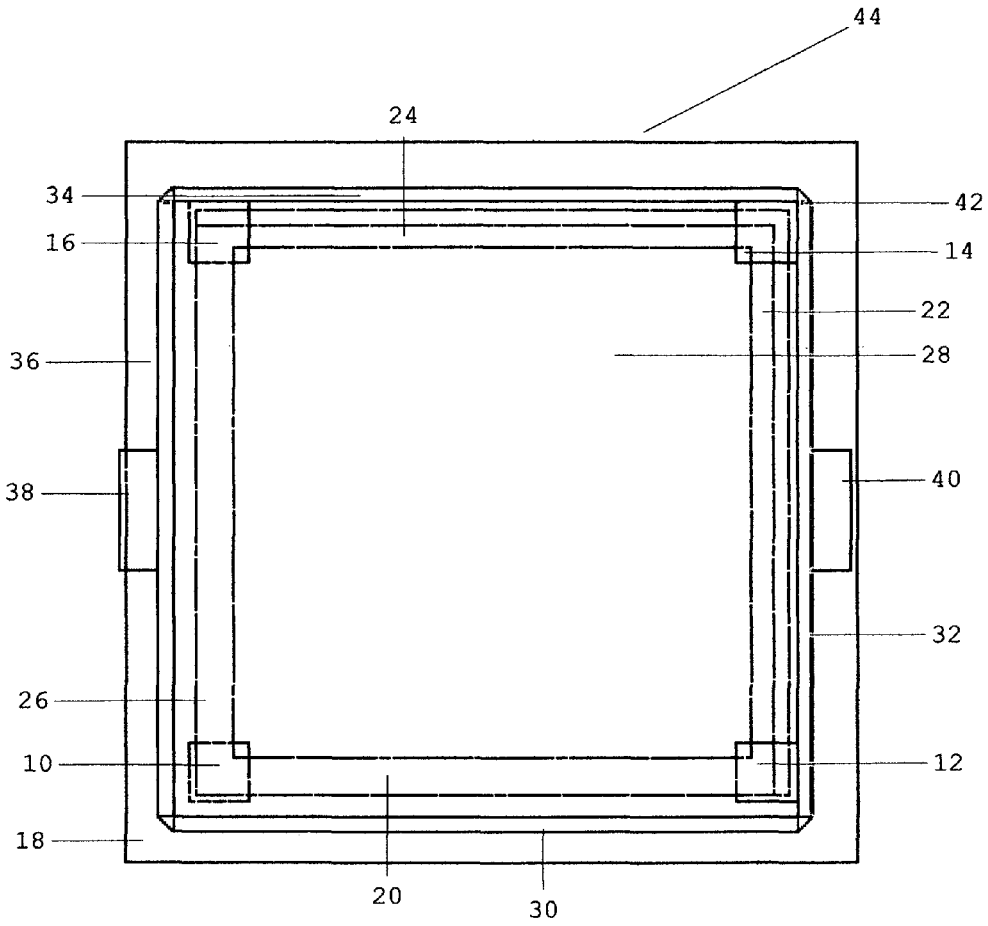
FIG. 3 is a top perspective view of an acrylic urn vault invention base with the sealing guide rails attached.

Referring now to FIG. 3, is a top perspective view of the embodiment provided and includes the view of the top portion 42 resting in its sealing position on the square acrylic base 18 and gripping the outer edges of the base guide rails 20, 22, 24, and 26. The inside edges of the four downward side walls rest tightly against the outside edges of the rails. This positioning stabilizes the top portion of the urn vault 44 and does not allow it to move or displace itself in any way once interred. Once the cremation urn vault 44 is ready to be interred, the top portion 42 of the vault can be solvently welded to the base 18 at the guide rails 20, 22, 24, 26. This will permanently seal the vault 44, air and water tight. The prospective is looking downward on the top portion 42 and looking through the generally square top acrylic panel 28 to the base 18. Also evident are the four stabilizing pedestal feet 10, 12, 14, 16, located 1" in a each base 18 corner.

FIG. 3 further illustrates the two opposing side handles 38 and 40 as well as the opposing acrylic side panels 32 and 36 and opposing end panels 30 and 34. When weight or backfill dirt is placed on the top portion 42 of the urn vault 44, the sealing nature of the acrylic urn vault 44 distributes the weight from the top to the base 18 and through the pedestal feet 10, 12, 14, 16. FIG. 3 also shows the ½" overlap of the base 18 which allows for much easier handling of the acrylic urn vault 44. Once the vault top 42 has been fastened to the base 18, when any weight, such as backfilling soil, is placed on top and around this acrylic urn vault 44, the weight is transferred to the base 18 at the guide rails and is then moved to the outside base 18 edges where it is dispersed.

Figure 4:
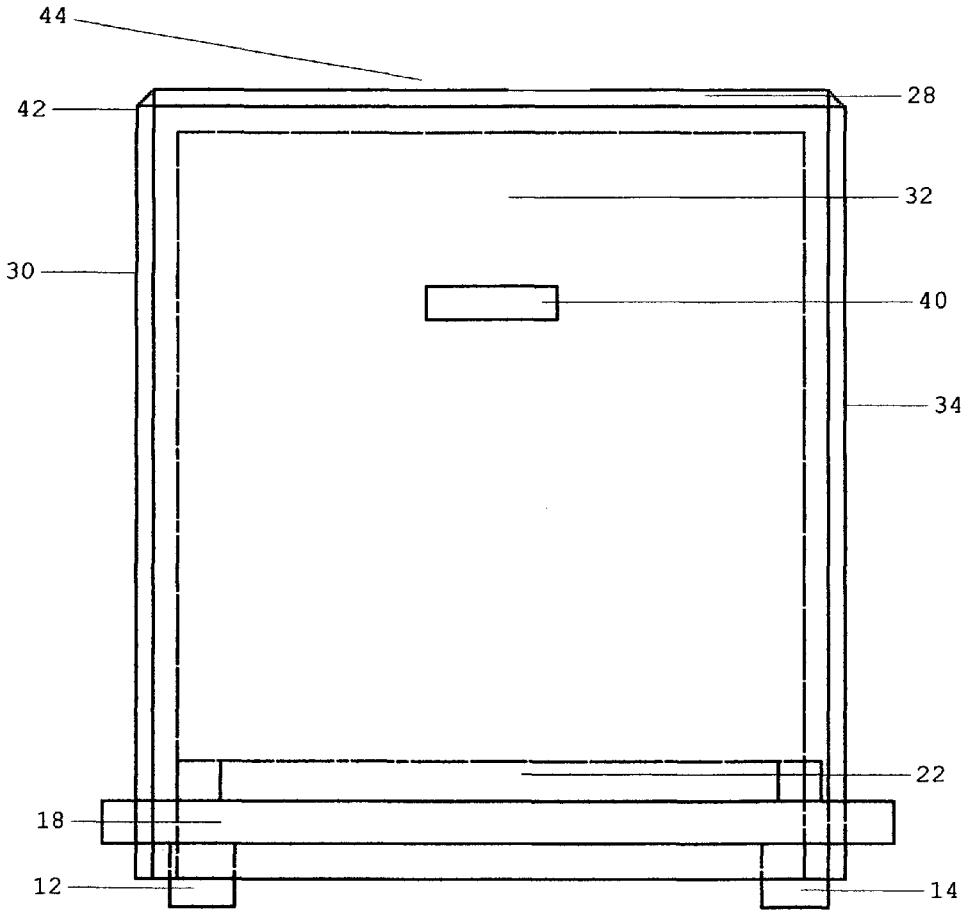
FIG. 4 is a left perspective view of an acrylic urn vault invention's top section in its sealed position on the base.

As further illustrated in FIG. 4, the present invention is viewed from a left perspective. More specifically, the embodiment of the invention illustrates an acrylic left side panel 32 solvently welded to a top acrylic panel 28 and adjoining acrylic end panels 30 and 34. Solvently welded to the left side panel 32 is the left side handle 40. Also evident is the square acrylic base 18 and two attached cubed left side pedestal feet 12 and 14. According to the preferred embodiment in FIG. 4, the rectangular acrylic top portion 42 is in its sealing position with the inside of the acrylic left side panel 32 resting firmly against the outside edge of the attached acrylic guide rail 22. The acrylic solvent welds the inside of the left side panel 32 with the outside wall of the acrylic guide rail 22. These 2 entities fuse together to form one single solid acrylic piece and the process is repeated with the opposing right side panel 36 and its adjacent guide rail 26 as well as with the opposing end panels 30 and 34 and their adjacent guide rails 20 and 24. This sealing position stabilizes the top portion 42 of the acrylic urn vault 44 and does not allow it to be moved or displaced in any way once it is buried. This in turn makes disengagement or a breach of the sealing system impossible.

The current invention also surpasses the benefits of any present urn burial vaults in that the acrylic urn vault 44 top portion 42 may be placed onto the base unit 18 without being solvently welded to the base guide rails and trapped air inside the top portion 42 will seal the acrylic urn vault 44 air-tight and water-tight, providing a completely sealed environment devoid of any penetration by water, moisture, air or insects. The additional benefit here is that this acrylic urn vault 44 after ground burial, may then be uncovered at some point in the future and reopened in order to add an additional urn. The weight of the overhead fill soil keeps the top portion 42 in place and guarantees the enclosed urn will remain protected and free of any underground contaminants. Once a second urn is added, the acrylic urn vault 44 top 42 may be solvently welded to the acrylic base 18 and its accompanying guide rails. By using the present invention, consumers may avoid additional expenses by not having to purchase duplicate urn burial vaults.

Figure 5:
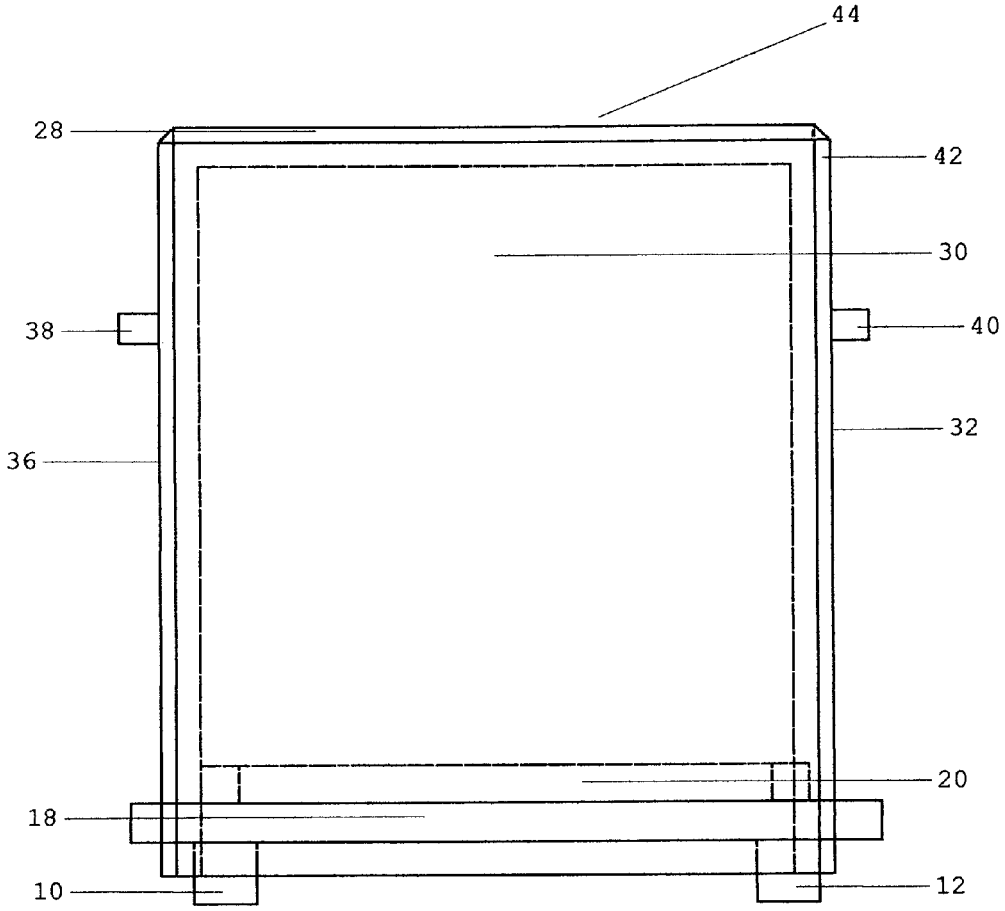
FIG. 5 is a front perspective view of an acrylic urn vault invention's top section in its sealed position on the base.

Referring now additionally to FIG. 5, illustrates a front perspective of the embodiment set forth herein. As in FIG. 4, FIG. 5 shows the acrylic urn vault 44 with the top portion 42 in its seated position on the base 18. The inside wall of the front acrylic side panel 30 is positioned directly against the outer edge of the front guide rail 20 and is solvently welded to that edge just as it is solvently welded to the adjoining left and right side panels 32 and 36 as well as to the top acrylic panel 28. Those skilled in the art will appreciate the location of the left side handle 40 and the right side handle 38 which again, are solvently welded to their respective acrylic side panels. Best illustrated in the present invention are the right front 10 and left front 12 base pedestal feet which aid in the handling of the acrylic urn vault 44. More specifically, FIG. 3 contemplates the unique sealing characteristic embodied by the present invention, separating it from all of the current urn vault solutions available to consumers today.

Figure 6:
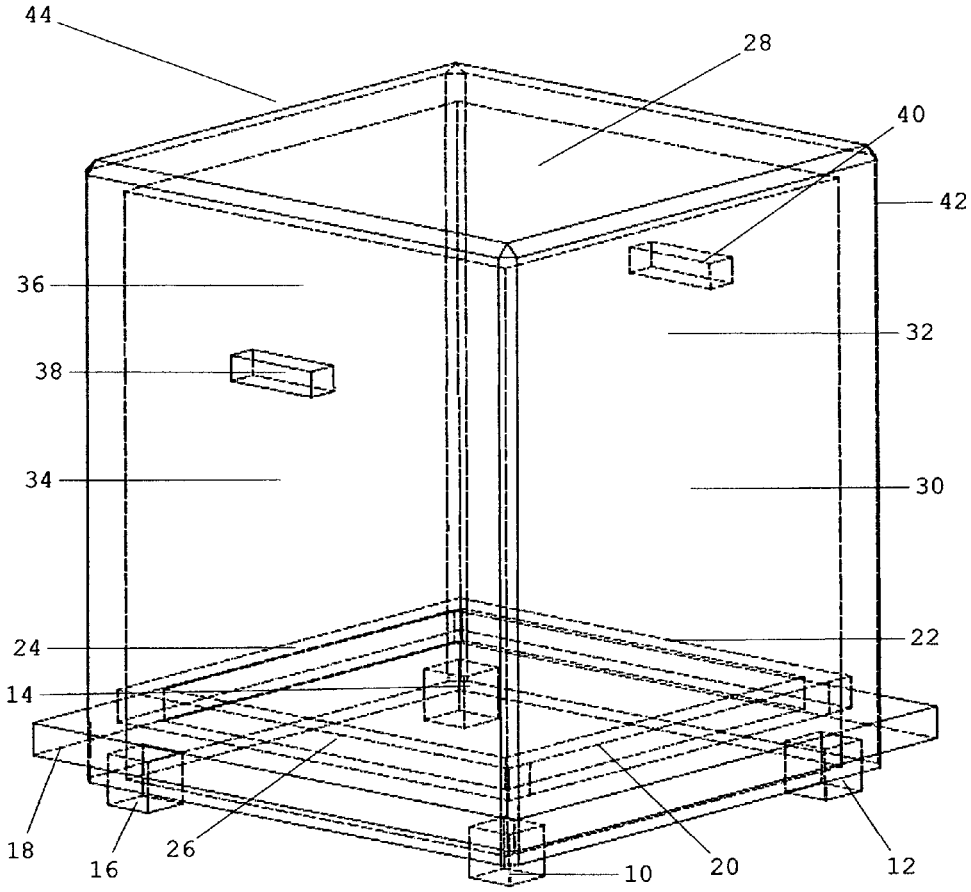
FIG. 6 is a right sectional view of an acrylic urn vault invention's top section in its sealed position on the base.
Figure 7:
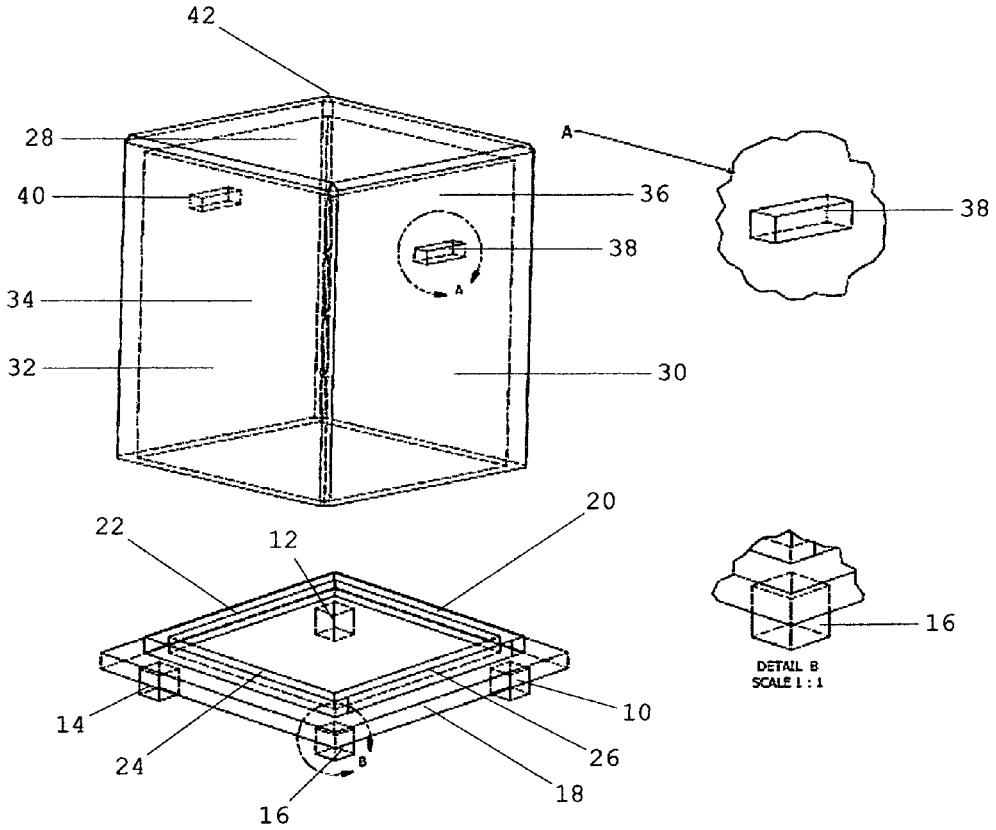
FIG. 7 is a front exploded view of an acrylic urn vault invention with the top section separated from the base.

As further illustrated in FIGS. 6-7, the generally square acrylic base 18 may include four cubed pedestal feet 10, 12, 14, 16, with one just inside each corner, enabling the acrylic base to be more easily maneuvered by funeral professionals and consumers alike. Further, as best illustrated in FIG. 7, the acrylic base 18 supports the guide rail sealing system with guide rails 20, 22, 24, 26 solvently welded to one another and the base, 1" in from the base 18 edges. Specifically, FIG. 6 details a right perspective of the present invention, illustrating the acrylic urn vault 44 top portion 42 securely positioned on the base 18 with generally square top acrylic panel 28 solvently welded to all four downward-leading side panels, front 30, left 32, rear 34, and right panel 36. With the top panel 28 and all four sides solvently welded to each adjoining acrylic panel, the top portion 42 becomes a single structural entity and further optimizes the incredible strength of the invention. Once the rectangular top portion 42 is solvently welded to the lower base 18 guide rails, the right side handle 38 and left side handle 40 allow the present invention to be easily lifted and moved into position for burial or relocated to a display position.

Referring additionally to FIG. 7, an embodiment of the present invention details a right perspective of the rectangular top section 42 prior to its fastening to the acrylic base unit 18. Again, the top acrylic panel 28 has been solvently welded to its downward-leading side panels front 30, left 32, rear 34, and right panel 36 with the right handle 38 and left handle 40 evident in their respective locations. Those skilled in the art will appreciate the presence of the base 18 and its guide rail fastening system with front guide rail 20, left guide rail 22, rear guide rail 24, and right guide rail 26. All are solvently welded to each other at the ends and to the base 18 underneath each rail. Raising the base for easier mobility are the base 18 pedestal feet, front right 10, front left 12, left rear 14, and right rear foot 16.

The invention has been described in considerable detail and those skilled in the art will recognize that modifications in the shape, size, materials, and arrangement of parts may be made. For example, alternate fastening systems may be used other than the preferred acrylic adhesives, IPS Weld-On 3 and Weld-On 4, which were in use in the acrylic urn vault 44 of this invention. These acrylic adhesives were chosen to be used on the smooth finished edges of said acrylic urn vault 44, leaving the joints clear of any residue once it dries. Other fastening systems are available for acrylic, including cyanoacrylate (super glue), methylene chloride, epoxy, and other acrylic cement adhesives. Also, other sizes and shapes may be selected to accommodate various cremation urn dimensions. For example, the embodiment of the invention may have its sides lengthened to any height for a taller urn or the base 18 may be stretched to accommodate longer cremation box-type urns or changed to add additional sides as in a triangular, pentagon, or hexagon shape. The invention base 18 could be circular as well and employ a round guide rail system. Materials may also vary with this invention. The guide rail sealing system would allow the acrylic urn vault 44 to be made of glass, bronze, marble, cement, wood, polyethylene or any biodegradable material as understood by those skilled in the art. This invention can also be made of acrylic ¾" thick walls to warrant extra protection from extraordinarily heavy equipment. This urn vault can also be manufactured to meet any urn size requirement. It should be understood that the current invention is not limited to the details disclosed here.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. An acrylic urn vault for providing an airtight, watertight, sealed environment to protect a cremation urn prior to and after ground burial, comprising:

a first side panel, a second side panel, a third side panel, and a fourth side panel, wherein each of the side panels is solvently welded to at least two of the side panels, wherein each the side panels comprises an interior surface and an exterior surface, and wherein at least two of the side panels comprise a first handle and a second handle for transporting the acrylic urn vault;

a top enclosure panel solvently welded to the first side panel, the second side panel, the third side panel, and the fourth side panel;

a base panel comprising a top side and a bottom side, wherein at least one of the first side panel, second side panel, third side panel, fourth side panel, top enclosure panel, and base panel consists of acrylic and is at least partially transparent;

a first guiderail, a second guiderail, a third guiderail, and a fourth guiderail solvently welded to the top side, wherein the interior surface of the first side panel is solvently welded to the first guiderail, wherein the interior surface of the second side panel is solvently welded to the second guiderail, wherein the interior surface of the third side panel is solvently welded to the third guiderail, and wherein the interior surface of the fourth side panel is solvently welded to the fourth guiderail; and a first pedestal foot, a second pedestal foot, a third pedestal foot, and a fourth pedestal foot attached to the bottom side.

2. The acrylic urn vault in accordance with claim 1, wherein the top enclosure panel comprises 10.75 inch by 10.75 inch by 0.625 inch cast acrylic.

3. The acrylic urn vault in accordance with claim 1, wherein the first side panel comprises 9.75 inch by 11.5 inch by 0.625 inch cast acrylic.

4. The acrylic urn vault in accordance with claim 1, wherein the second panel comprises 10.75 inch by 11.5 inch by 0.625 inch cast acrylic.

5. The acrylic urn vault in accordance with claim 1, wherein the third panel comprises 9.75 inch by 11.5 inch by 0.625 inch cast acrylic.

6. The acrylic urn vault in accordance with claim 1, wherein the fourth panel comprises 10.75 inch by 11.5 inch by 0.625 inch cast acrylic.

7. The acrylic urn vault in accordance with claim 1, wherein the first guide rail comprises 9 inch by 0.625 inch by 0.625 inch cast acrylic.

8. The acrylic urn vault in accordance with claim 1, wherein the second guide rail comprises 9 inch by 0.625 inch by 0.625 inch cast acrylic.

9. The acrylic urn vault in accordance with claim 1, wherein the third guide rail comprises 9 inch by 0.625 inch by 0.625 inch cast acrylic.

10. The acrylic urn vault in accordance with claim 1, wherein the fourth guide rail comprises 9 inch by 0.625 inch by 0.625 inch cast acrylic.

11. The acrylic urn vault in accordance with claim 1, wherein the first handle comprises 2 inch by 0.5 inch by 0.375 inch cast acrylic.

12. The acrylic urn vault in accordance with claim 1, wherein the second handle comprises 2 inch by 0.5 inch by 0.375 inch cast acrylic.

13. The acrylic urn vault in accordance with claim 1, wherein the first pedestal foot comprises 1 inch by 1 inch by 1 inch cast acrylic.

14. The acrylic urn vault in accordance with claim 1, wherein the second pedestal foot comprises 1 inch by 1 inch by 1 inch cast acrylic.

15. The acrylic urn vault in accordance with claim 1, wherein the third pedestal foot comprises 1 inch by 1 inch by 1 inch cast acrylic.

16. The acrylic urn vault in accordance with claim 1, wherein the fourth pedestal foot comprises 1 inch by 1 inch by 1 inch cast acrylic.

17. The acrylic urn vault in accordance with claim 1, wherein the first handle and the second handle are spaced 3 inches from a top of said at least two of the side panels.

18. An acrylic urn vault for providing an airtight, watertight, sealed environment to protect a cremation urn prior to and after ground burial, comprising:

a 9.75 inch by 11.5 inch by 0.625 inch cast acrylic first side panel, a 10.75 inch by 11.5 inch by 0.625 inch cast acrylic second side panel, a 9.75 inch by 11.5 inch by 0.625 inch cast acrylic third side panel, and a 10.75 inch by 11.5 inch by 0.625 cast acrylic fourth side panel, wherein each of the side panels is solvently welded to at least two other of the side panels, wherein each of the side panels comprises an interior surface and an exterior surface, and wherein at least two of the side panels comprise a 2 inch by 0.5 inch by 0.375 inch cast acrylic side handle for transporting the acrylic urn vault, wherein each of said side handles is spaced 3 inches from a top of said at least two of the side panels;

a 10.75 inch by 10.75 inch by 0.625 inch cast acrylic top enclosure panel solvently welded to the first side panel, the second side panel, the third side panel, and fourth side panels;

a base panel having a top side and a bottom side; and wherein at least one of the first side panel, second side panel, third side panel, fourth side panel, top enclosure panel, and base panel is at least partially transparent;

a first 9 inch by 0.625 inch by 0.625 inch cast acrylic guiderail, a second 9 inch by 0.625 inch by 0.625 inch cast acrylic guiderail, a third 9 inch by 0.625 inch by 0.625 guiderail, and a fourth 9 inch by 0.625 inch by 0.625 inch cast acrylic guiderail solvently welded to the top side of the base panel, wherein the first side panel is solvently welded to the first guiderail, wherein the second side panel is solvently welded to the second guiderail, wherein the third side panel is solvently welded to the third guiderail, wherein the fourth side panel is solvently welded to the fourth guiderail; and a first 1 inch by 1 inch by 1 inch cast acrylic pedestal foot, a second 1 inch by 1 inch by 1 inch cast acrylic pedestal foot, a third 1 inch by 1 inch by 1 inch cast acrylic pedestal foot, and a fourth 1 inch by 1 inch by 1 inch cast acrylic pedestal foot attached to the bottom side.

* * * * *